US008397828B2

(12) United States Patent
Hopmann et al.

(10) Patent No.: US 8,397,828 B2
(45) Date of Patent: Mar. 19, 2013

(54) SPOOLABLE DOWNHOLE CONTROL SYSTEM AND METHOD

(75) Inventors: Don A. Hopmann, Alvin, TX (US); Luis E. Mendez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 334 days.

(21) Appl. No.: 12/731,826

(22) Filed: Mar. 25, 2010

(65) Prior Publication Data

US 2011/0232921 A1 Sep. 29, 2011

(51) Int. Cl.
*E21B 19/22* (2006.01)
*E21B 17/02* (2006.01)

(52) U.S. Cl. ..... 166/385; 166/242.2; 166/380

(58) Field of Classification Search ..... 166/380, 166/385, 242.2, 242.6, 242.3, 372
See application file for complete search history.

(56) References Cited

U.S. PATENT DOCUMENTS 2,620,740 A * 12/1952 Garrett et al. ..... 417/113
3,050,121 A * 8/1962 Garrett et al. ..... 166/285
5,152,343 A * 10/1992 Kilgore ..... 166/242.2
5,165,480 A * 11/1992 Wagoner et al. ..... 166/375
5,172,765 A 12/1992 Sas-Jaworsky et al.
5,745,047 A 4/1998 Van Gisbergen et al.
6,464,004 B1 * 10/2002 Crawford et al. ..... 166/250.01
6,561,278 B2 * 5/2003 Restarick et al. ..... 166/378
6,644,403 B2 * 11/2003 Pichery et al. ..... 166/250.11
6,715,550 B2 4/2004 Vinegar et al.
6,766,853 B2 * 7/2004 Restarick et al. ..... 166/242.6
6,923,273 B2 8/2005 Terry et al.
6,981,553 B2 1/2006 Stegemeier et al.
7,021,388 B2 * 4/2006 Williams ..... 166/372
7,036,601 B2 * 5/2006 Berg et al. ..... 166/385
7,055,592 B2 6/2006 Bass et al.
7,147,059 B2 12/2006 Hirsch et al.
7,311,144 B2 * 12/2007 Conrad ..... 166/270.1
7,554,458 B2 6/2009 Hudson et al.
7,708,057 B2 * 5/2010 Aivalis et al. ..... 166/77.2
7,748,466 B2 * 7/2010 Aivalis et al. ..... 166/383
7,845,415 B2 12/2010 Allen
7,909,101 B2 * 3/2011 Conrad ..... 166/300

(Continued)

OTHER PUBLICATIONS

International Search Report and Written Opinion; Mail Date Jul. 26, 2011; International Application No. PCT/US2011/023696; International Filing Date Feb. 4, 2011; Korean Intellectual Property Office; International Search Report 5 pages; Written Opinion 4 pages.
Chaudhuri, Jay et al. "Quick Disconnectable Catenary Electrical Umbilical for Bruce Field Development," [Abstract Only], Offshore Technology Conference, May 3-6, 1993, Houston Texas.

(Continued)

*Primary Examiner* — Jennifer H Gay
(74) *Attorney, Agent, or Firm* — Cantor Colburn LLP

(57) ABSTRACT

A spoolable downhole control system includes a length of one or more lines suitable for the downhole environment. The spoolable downhole control system also includes one or more components disposed in signal bearing communication with the one or more lines and along a length of the one or more lines, prior to the system being connected with a string. The components are capable of actuating an operation. A method for creating a downhole system includes spooling out the spoolable downhole control system and joining the one or more components with one or more subs of the tubing string.

22 Claims, 6 Drawing Sheets

U.S. PATENT DOCUMENTS

| | | | | |
|---|---|---|---|---|
| 2002/0029883 | A1* | 3/2002 | Vinegar et al. | 166/250.15 |
| 2002/0112861 | A1* | 8/2002 | Restarick et al. | 166/384 |
| 2003/0164240 | A1* | 9/2003 | Vinegar et al. | 166/372 |
| 2004/0065443 | A1* | 4/2004 | Berg et al. | 166/380 |
| 2004/0094311 | A2 | 5/2004 | Hopper et al. | |
| 2004/0108118 | A1* | 6/2004 | Williams | 166/375 |
| 2004/0262011 | A1* | 12/2004 | Huckabee et al. | 166/369 |
| 2005/0072564 | A1 | 4/2005 | Grigsby et al. | |
| 2006/0137881 | A1* | 6/2006 | Schmidt et al. | 166/372 |
| 2008/0066905 | A1* | 3/2008 | Aivalis et al. | 166/250.01 |
| 2008/0311776 | A1 | 12/2008 | Cox et al. | |
| 2010/0059233 | A1* | 3/2010 | Smithson et al. | 166/385 |
| 2010/0224368 | A1 | 9/2010 | Mason | |
| 2010/0294506 | A1* | 11/2010 | Rodriguez et al. | 166/372 |
| 2010/0319936 | A1* | 12/2010 | Alff et al. | 166/385 |
| 2011/0194817 | A1* | 8/2011 | Hopmann et al. | 385/55 |
| 2011/0210542 | A1 | 9/2011 | Makselon et al. | |
| 2011/0232921 | A1* | 9/2011 | Hopmann et al. | 166/385 |
| 2011/0272148 | A1 | 11/2011 | Lovell et al. | |

OTHER PUBLICATIONS

Ellisor, Tim W. et al. "Canyon Express Deepwater Umbilical and Control System: Design and Installation" [Abstract Only], Offshore Technology Conference, May 5-8, 2003, Houston Texas.

Mitsui, T. et al. "Development of Composite Fiber-Optic Electric-Power Umbilical Cable and Optical Feedthrough for Deep Ocean Mining" [Abstract Only], International Wire and Cable Symposium Proceedings, Jan. 1983, pp. 125-133.

Moore, B.K. "Rigless Completions: A Spoolable Coiled-Tubing Gas-Lift System" [Abstract Only], Offshore Technology Conference, May 3-6, 1993, Houston Texas.

"Spoolable Composite Tubular Applications", [online], [retrieved on Jun. 24, 2010]; retrieved from the Internet http://www.compositesworld.com/articles/spoolable-composite-tubular-applications.

* cited by examiner

SPOOLABLE DOWNHOLE CONTROL SYSTEM AND METHOD

BACKGROUND

In the drilling and completion industry it is known to employ spoolable control and or monitoring lines whether they be hydraulic lines, electric lines, fiber optic lines, combinations of these, etc. Such lines are delivered as long continuous lines that are then spliced at any location along the tubing string where such a splice is necessary. Generally, splices are needed anywhere a facilitation of the control or monitoring action of the line is needed including at valves and other mechanical control components controllable or monitorable by the lines noted above.

Splicing is a very reliable technology but is time consuming and labor intensive. For each splice, which occurs twice for every connection except for a last one along a line, the line must be cut, stripped connected and pressure tested. Such connections slow down progression of tubing strings being run into the borehole and hence detract from productivity and efficiency. The art is insatiably interested in any advance that improves either of these metrics.

SUMMARY

A spoolable downhole control system including a length of one or more lines suitable for the downhole environment; and one or more components disposed in signal bearing communication with the one or more lines and along a length of the one or more lines, prior to the system being connected with a string, the components capable of actuating an operation.

A method for creating a spoolable downhole control system including interconnecting a spoolable line with one or more components the components having the ability to actuate an operation in a downhole environment subsequent to being joined with a string.

BRIEF DESCRIPTION OF THE DRAWINGS

Referring now to the drawings wherein like elements are numbered alike in the several Figures.

DETAILED DESCRIPTION

Figure 1:
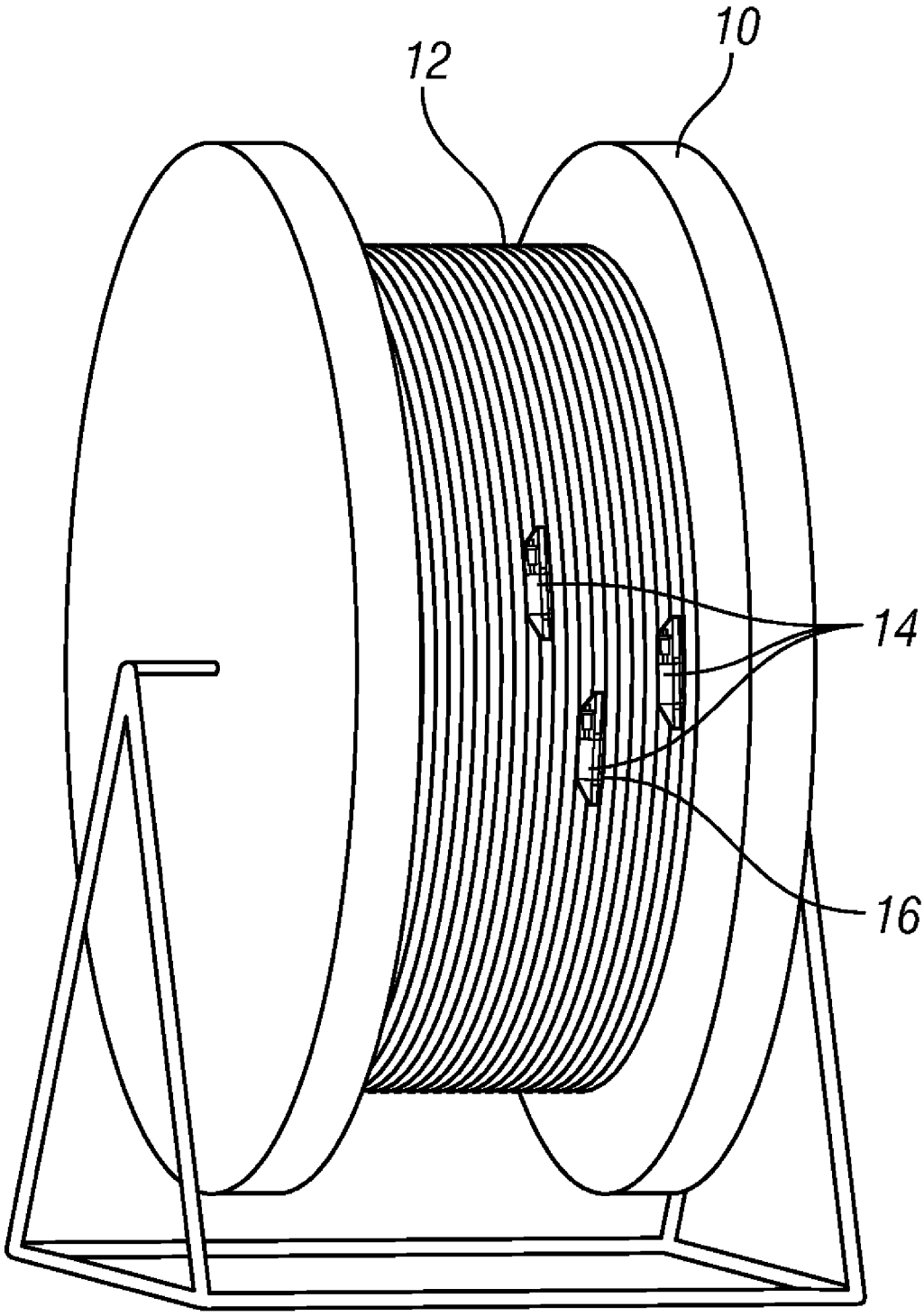
FIG. 1 is a schematic perspective view of a spool of conductor and component line disclosed herein.

Referring to FIG. 1, a schematic representation of a spoolable control system 10 containing a length of spooled line 12 is represented. It is noted that while "line" 12 is discussed in the singular, the line may comprise one or more lines. Further illustrated are three components 14 in signal bearing communication with the line 12 and each covered in a protective sleeve 16. It is further noted that the term signal is intended to cover, communication signal, power signal, or any other kind of signal that might be desirable. Although only three of the components are illustrated it is to be understood that more or fewer may be included as desired or as needed for a particular application.

Figure 2:
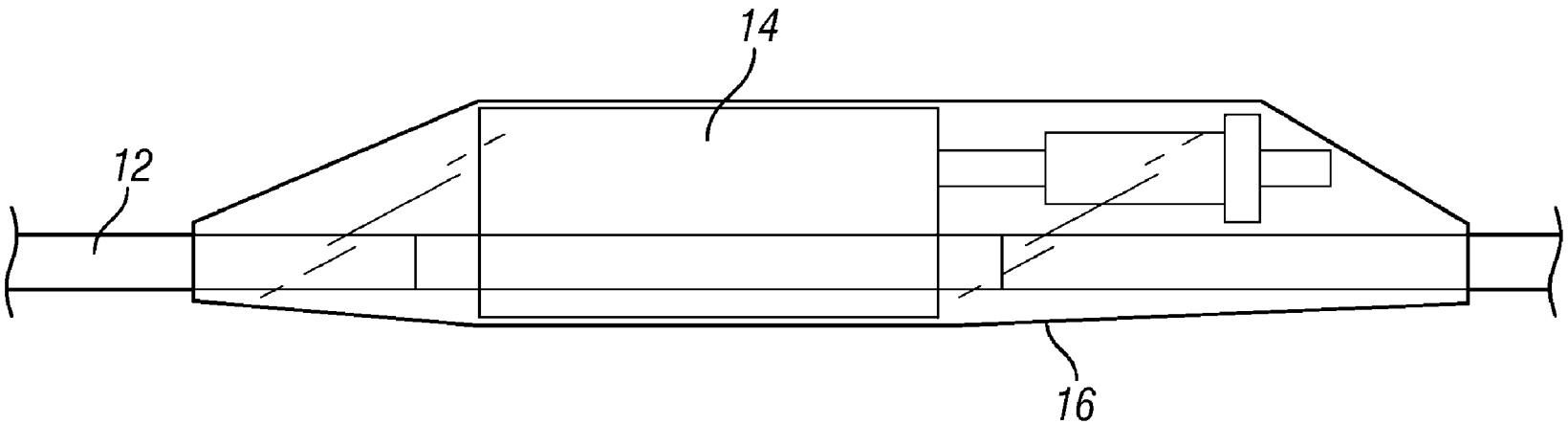
FIG. 2 is a schematic view of one of one or more components along the line of FIG. 1 illustrated in an enlarged format.

Referring to FIG. 2, an enlarged view of one of the components 14 with sleeve 16 is presented. The component is illustrated on a line 12, which is illustrated as ¼ inch capillary line. Such lines are well known to those of skill in the art for use as hydraulic control lines, Tubing Encapsulated Conductor (TEC) lines, and as jackets for other lines such as fiber optic lines. Other kinds of lines can be substituted as needed.

The protective sleeve 16 illustrated in FIGS. 1 and 2 comprises a material having sufficient mechanical characteristics to provide some protection to the component 14 during spooling, unspooling and handling. The protective sleeve 16 is intended to reduce contamination infiltration and to reduce edge damage from minor bumping or scraping of the connector. The sleeve may comprise tape such as silicone tape, shrink-wrap material or similar material.

Figure 3:
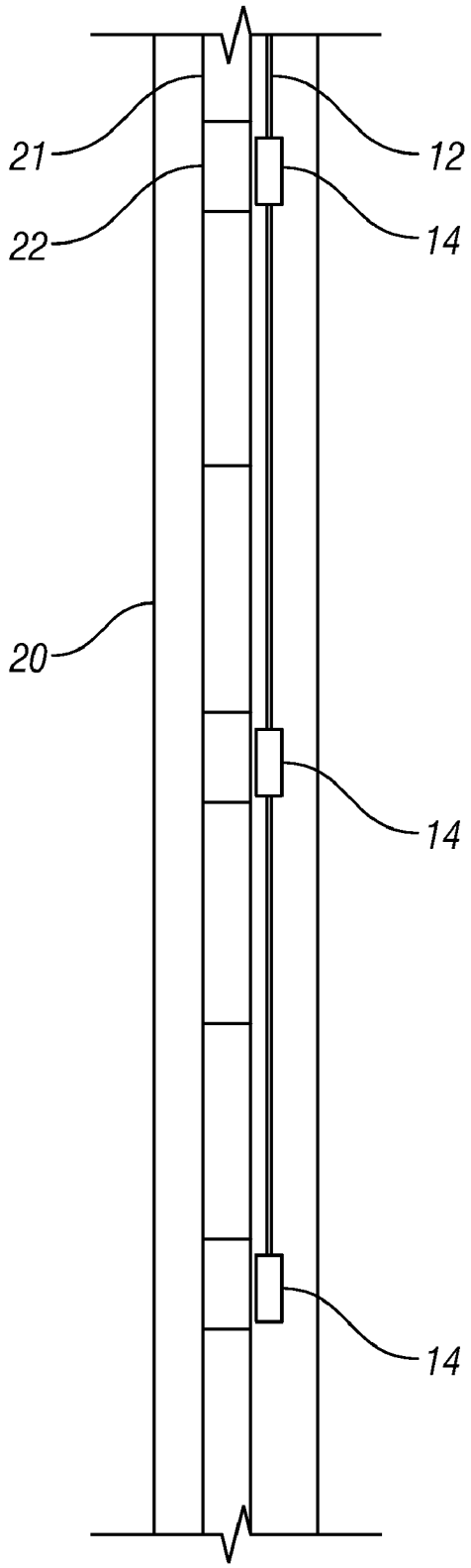
FIG. 3 is a schematic view of a series of components installed on a string in a borehole.

Moving to FIG. 3, a schematic view of the system 10 in a deployed condition within a borehole 20 and on a tubing string 21. It is to be appreciated that each component 14 is located at a predesigned sub 22 that is configured to cooperate with an embodiment of the components 14 or at a place where an opening will be created in the string for the purpose of cooperating with the component. Further disclosure about the cooperative subs 22 or opening will ensue hereunder. It is desirable for sufficient line 12 to be manufactured into the system 10 to allow for the components 14 to be properly placed on the string 21 without excess line 12 and certainly without being too short, where the embodiment is a predesigned string embodiment. Commonly then, in a predesigned string embodiment, the system will likely be created for a particular completion where all distances between subs 22 are known. Where the embodiment is one of a generic type, this will merely require the additional step of managing the excess line or if the string is not predesigned with openings, the openings will need to be created. Management of excess line may be effected, for example, by rotating the line 12 about the string 21 to take up excess line length. In the FIG. 3 illustration, which is a predesigned string embodiment, there are two joints between each sub 22 so that the system 10 will have equidistantly spaced components 14. More or fewer joints can, of course, be substituted at the design stage with corresponding changes in intercomponent length of line 12.

Figure 4:
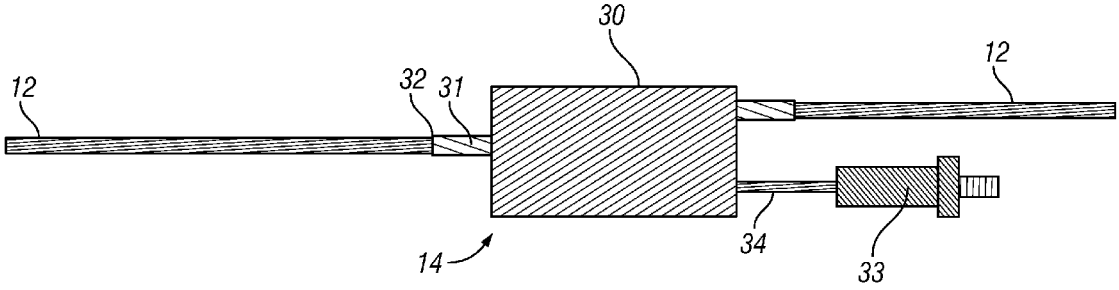
FIG. 4 is a further enlarged schematic view of a component without a protective sleeve.

Referring to FIG. 4, an enlarged schematic view of one of the components 14 is illustrated. The components comprise at least one line stub 31 and securement such as an orbital weld 32 in order to secure the component 14 to the line 12. Each component 14 further comprises a module 30 that may be an electronics module, a hydraulic module, an optics module, sensory or command, etc. In one embodiment the module 30 will be sealed at a manufacturing facility to reduce work on the rig floor and ensure a reliable component. Where the component is one that is not positioned at an end of the line 12, a further stub 31 and orbital weld 32 connects to another line 12 to continue on to one or more further components 14. Operably interconnected to the module 30 is a conductor 34 that may be constructed to have flexibility or to not have flexibility as desired. The conductor 34 provides a communication pathway from the module 30 to a valve actuator 33 or other type of actuator (may be mechanical, optical, electrical, hydraulic, etc and may have any function desired). Interconnection of the components 14 with subs 22 is illustrated in FIGS. 5 and 6.

Figure 5:
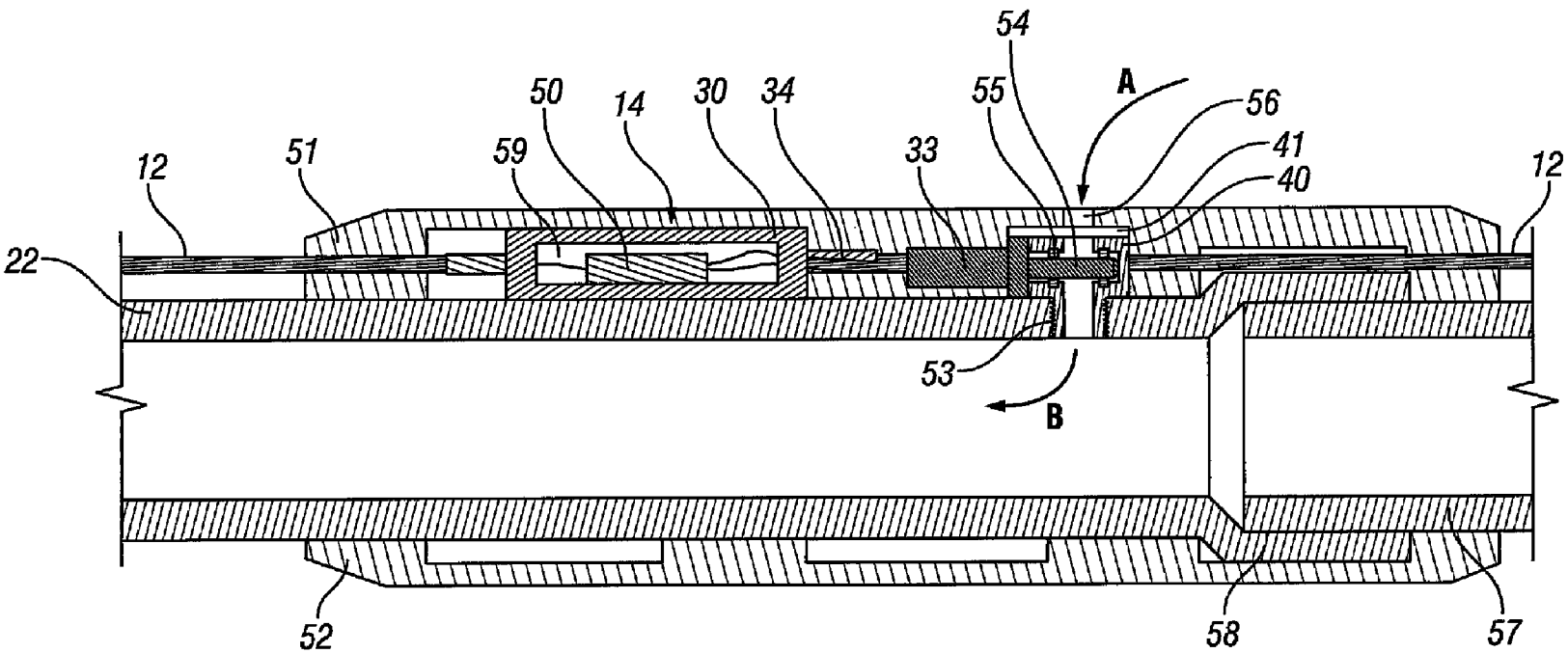
FIG. 5 is a schematic cross section view of a portion of the line and one component in position along a string and connected to the string.

Referring to FIG. 5, a cross sectional view of the component 14 mounted to a sub 22 is illustrated. Initially it is pointed out that sub 22, is endowed with an opening 53. The opening 53 happens to be threaded in this illustration and thereby constitutes one embodiment of the opening 53. It can be of other forms and has for its function to engage a boss 40, which has for its purpose to operably engage with the actuator. In this embodiment the boss 40 is a separate piece but as will be appreciated during the discussion of FIG. 6 hereunder, it need not be. The sub 22 in some iterations will be preconfigured with the opening 53 before arriving at a rig floor. It is noted however that it is possible to create the opening and thread it right at the rig floor if necessary. Since a significant reason for the invention is to reduce time for running a string into a borehole, it is not likely that one would want to create openings 53 on the rig floor although it is possible. Turning back to FIG. 5, the sub 22 is illustrated connected at a downhole end 58 to another joint of tubing 57 for environment and clamp interconnection (discussed more hereunder). In the Figure, it can be appreciated that the boss 40 has been threadedly connected to the sub 22 and oriented so that its configuration lends itself to being interconnected with the actuator 33. The orientation of boss 40 can be achieved through a timed thread or simply can be adjustable such as by making the thread a little longer than necessary so the boss can be oriented as desired. In such an adjustable configuration a seal such as an O-ring might be used to ensure fluid seal through the thread area of opening 53. The boss is configured with a through port 41 that will allow fluid to flow therethrough as indicated by arrows A and B if not blocked by another member. The actuator 33 is capable of actuating an operation of some kind in the downhole environment. The operation may involve facilitating fluid flow and may involve the changing of position of a valve member. In the present embodiment the actuator includes a valve plunger 54 (having in one embodiment seals 55 such as o-ring seals) or other means of interrupting the through port 41 thereby enabling the valve plunger to facilitate a fluid flow operation through the opening 53. The plunger 54 is positionable to occlude, choke or facilitate flow through the through port 41 based upon a command received from the line 12. In one embodiment, the command is sent along line 12, conveyed into the module 30 to reach valve control electronics 50 so that the command can be parsed and then conveyed on to the actuator 33 through conductor 34, which in one embodiment is a flexible conductor to facilitate installation. It will be appreciated that the actual function of a valve actuator and electronics package is similar to the prior art but note that such devices have always been individual components attached to a string at the rig floor and interconnected using conventional splicing techniques at great expense and at a temporally disadvantageous rate. With the embodiments of the invention, cost and time are substantially reduced because the components are all a part of the line 12 and hence need no splicing or laborious interconnection but rather require merely attachment to a sub and a clamp to hold them in place. The clamp 51 is generally conventional in the art and may be configured in many ways provided that its purpose of securing the component 14 to the sub 22 is discharged. In one embodiment the clamp 51 is a two-piece clamp 51, 52 that is bolted together conventionally. Clear to one of skill in this art, the clamp will be configured with recesses sufficient to accommodate the components 14 without damaging the same and at least one fluid flow port 56 to allow fluid communication from or to the boss 40 and an annular space radially outwardly disposed of the clamp.

Figure 6:
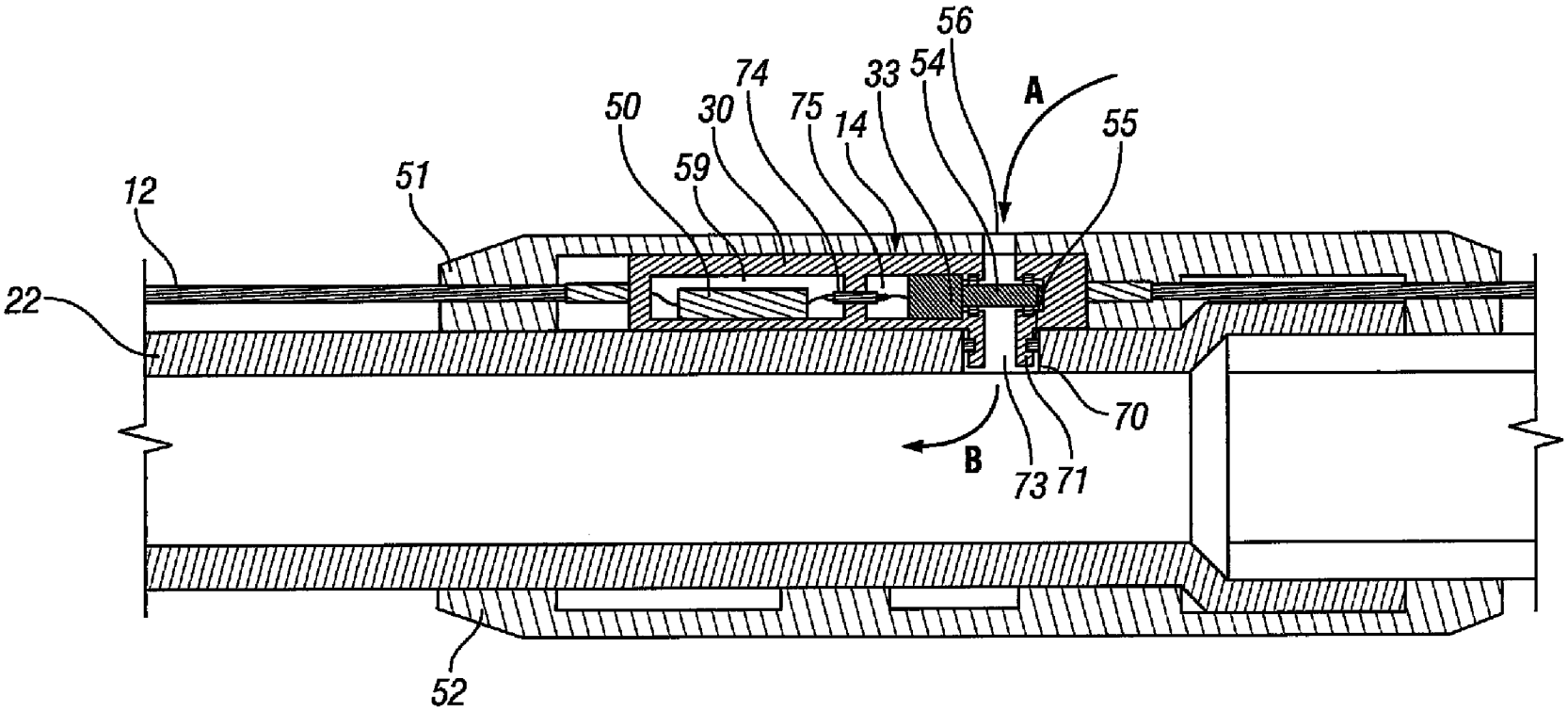
FIG. 6 is a schematic cross sectional view of an alternate embodiment of a component in position along a string and connected to the string.

Referring to FIG. 6, an alternate embodiment of the system 10 is illustrated where the threaded boss 40 is no longer required. Rather the component 14 is provided with an integral boss 71. For practicality reasons, this boss 71 is a push in variety as threading the entire component with the inherent difficulties the line would present to such an operation would be relatively prohibitive. It is noted however that the push in configuration of the boss 71 may also be applied to the boss 40. In either case, the boss 71 configuration will include a fluid seal of some type such as an o-ring as illustrated. Also as illustrated, the boss 71 is pushed into opening 70 in the sub 22, and opening 73 in the boss 71 allows fluid to flow therethrough, as indicated by arrows A and B, if not blocked by another member, as described with reference to FIG. 5.

The embodiment of FIG. 6 further differs from that of FIG. 5 in that the component includes all of its parts within the module 30. The module 30 is divided into two chambers 59 and 75, for the electronics and actuator, respectively. Extending though a partition 76 of the module 30 is a high-pressure feed through 74 to supply actuator 33 with command signals. In other respects this embodiment is similar to that of FIG. 5.

As noted above, in order to maximize efficiency in use of the spoolable downhole control system as disclosed herein, the particular line may be planned to include the components 14 at intervals along the line that are related to the actual spacing of the subs on the string to be created. In this event, the components will naturally come off the spool proximate to the location where they need to be joined with subs of the string.

In use, a method for creating a downhole system using the disclosed spoolable downhole control system includes creating a spool of line and components; configuring a string including one or more openings at strategic places along the configured string; and mating a component with one or more of the one or more openings. It is to be understood that the openings may be in subs specifically created for this purpose and hence the openings may be threaded, smooth, etc. as prescribed or the openings may be created on the rig floor at appropriate places along the string. Configuring the string therefore encompasses assembling a predesigned string having the openings in subs or building a string on demand and creating openings such as by drilling and optionally tapping the openings. Further, the creating of the spool may be according to a predesigned plan of deployment of the components so that a preselected length of line exists between each component and is configured to specifically work with a predesigned string or the spool can be made up as a generic and lengths of line will be managed either by the taking up of line as described above or by creating the openings in the string on the rig floor to coincide with the locations of the components on the line.

While in the above description there is a suggestion that electrical connection is contemplated, it is emphasized that any signal and any signal carrying conductor is contemplated for use with the spoolable downhole control system and method disclosed herein.

While one or more embodiments have been shown and described, modifications and substitutions may be made thereto without departing from the spirit and scope of the invention. Accordingly, it is to be understood that the present invention has been described by way of illustration and not limitation.

The invention claimed is:

1. A spoolable downhole control system comprising:

a length of one or more lines suitable for the downhole environment; and one or more components disposed in signal bearing communication with the one or more lines and along a length of the one or more lines, prior to the system being connected with a string, one or more of the one or more components including an actuator capable of actuating an operation, and the one or more components are configured to engage and fluidically connect to an opening in a string;

wherein the length of the one or more lines and the one or more components are spooled together prior to the system being connected with a string.

2. A spoolable downhole control system as claimed in claim 1, wherein the actuator actuates a valve.

3. A spoolable downhole control system as claimed in claim 2, wherein the valve is a plunger.

4. A spoolable downhole control system as claimed in claim 1, wherein the one or more components are configured to threadably engage an opening in a string.

5. A spoolable downhole control system as claimed in claim 1, wherein the one or more components are configured to sealingly engage an opening in a string.

6. A spoolable downhole control system as claimed in claim 1, wherein one or more of the one or more components includes a module.

7. A spoolable downhole control system as claimed in claim 6, wherein the actuator is in operable communication with the module.

8. A spoolable downhole control system as claimed in claim 1, wherein one or more of the one or more components includes a module, and the actuator and module are in flexible communication with each other.

9. A spoolable downhole control system as claimed in claim 1, wherein the system further includes a boss receptive of the actuator and configured for engagement with a string.

10. A spoolable downhole control system as claimed in claim 9, wherein the boss is an integral part of the component.

11. A downhole system comprising:

a spoolable downhole control system as claimed in claim 1; and a string to which is assembled the spoolable downhole control system.

12. A downhole system as claimed in claim 11 wherein the string is a predesigned string.

13. A downhole system as claimed in claim 12 wherein the spoolable downhole control system is specifically manufactured for the predesigned string.

14. A downhole system as claimed in claim 11 wherein the spoolable downhole control system is generic.

15. A downhole system as claimed in claim 14 wherein the string is predesigned and the spoolable downhole control system is line length managed.

16. A downhole system as claimed in claim 11 wherein the string is generic and one or more openings to receive components of the spoolable downhole control system are created at a time of installation of the string.

17. A method for creating a downhole system comprising:

spooling out spoolable downhole control system of claim 1; and joining the one or more components with one or more subs of the tubing string.

18. A method for creating a downhole system as claimed in claim 17 wherein the joining is threading one or more of the one or more components to preexisting openings in the string.

19. A method for creating a downhole system as claimed in claim 17 wherein the joining is pressing one or more of the one or more components to preexisting openings in the string.

20. A method for creating a downhole system as claimed in claim 17 wherein the joining further comprises creating an opening in the string for one or more of the one or more components.

21. A method for creating a downhole system as claimed in claim 17 wherein the method further comprises managing excess line.

22. A method for creating a spoolable downhole control system comprising interconnecting a spoolable line with one or more components, the components including an actuator having the ability to actuate an operation in a downhole environment subsequent to being joined and fluidically connected with an opening in a string, and spooling the one or more components with the spoolable line prior to connecting the spoolable downhole control system with the string.

* * * * *